US010054874B2

(12) United States Patent
Oniki

(10) Patent No.: US 10,054,874 B2
(45) Date of Patent: Aug. 21, 2018

(54) ELASTIC MEMBER

(71) Applicant: BRIDGESTONE CORPORATION, Tokyo (JP)

(72) Inventor: Yoshihiko Oniki, Tokyo (JP)

(73) Assignee: BRIDGESTONE CORPORATION, Tokyo (JP)

( * ) Notice: Subject to any disclaimer, the term of this patent is extended or adjusted under 35 U.S.C. 154(b) by 0 days.

(21) Appl. No.: 15/507,420

(22) PCT Filed: Jul. 29, 2015

(86) PCT No.: PCT/JP2015/071484
§ 371 (c)(1),
(2) Date: Feb. 28, 2017

(87) PCT Pub. No.: WO2016/035483
PCT Pub. Date: Mar. 10, 2016

(65) Prior Publication Data

US 2017/0285516 A1 Oct. 5, 2017

(30) Foreign Application Priority Data

Sep. 2, 2014 (JP) ..... 2014-177874

(51) Int. Cl.
*G03G 15/08* (2006.01)
*G03G 15/16* (2006.01)

(52) U.S. Cl.
CPC ..... *G03G 15/0841* (2013.01); *G03G 15/0889* (2013.01); *G03G 15/0898* (2013.01); *G03G 15/161* (2013.01)

(58) Field of Classification Search
CPC ..... G03G 15/0841; G03G 15/0899; G03G 15/0898; G03G 15/161
USPC ..... 399/105
See application file for complete search history.

(56) References Cited

U.S. PATENT DOCUMENTS 8,478,171 B2 7/2013 Sasaki
2017/0036444 A1* 2/2017 Kihara ..... B41J 2/1623

FOREIGN PATENT DOCUMENTS

JP 6-89062 A 3/1994
JP 2001-42663 A 2/2001
JP 2002-214895 A 7/2002
JP 2004-21052 A 1/2004
(Continued)

OTHER PUBLICATIONS

International Search Report of PCT/JP2015/071484, dated Sep. 15, 2015. [PCT/ISA/210].
(Continued)

*Primary Examiner* — Susan Lee
(74) *Attorney, Agent, or Firm* — Sughrue Mion, PLLC

(57) ABSTRACT

Provided is an elastic member which is obtained by forming a resin coating layer on at least a part of the surface of a base that is formed of an elastic material, and which is characterized in that the resin coating layer is a coating film that contains 1.5-45 parts by mass of a low-friction powder per 100 parts by mass of a base resin and has a 100% modulus of 22-30 MPa. This elastic member has a resin coating layer that has a good balance between film formability and low friction, and is suitable as a sealing member for an opening part of a toner container that is provided on a toner cartridge of a printer, a copy machine or the like.

7 Claims, 3 Drawing Sheets

(56) References Cited

FOREIGN PATENT DOCUMENTS

| | | | |
|---|---|---|---|
| JP | 2011-64930 | A | 3/2011 |
| JP | 2014-74863 | A | 4/2014 |

OTHER PUBLICATIONS

Communication dated Mar. 13, 2018 from the Japanese Patent Office in counterpart application No. 2014-177874.

* cited by examiner

ELASTIC MEMBER

CROSS REFERENCE TO RELATED APPLICATIONS

This application is a National Stage of International Application No. PCT/JP2015/071484 filed Jul. 29, 2015, claiming priority based on Japanese Patent Application No. 2014-177874, filed Sep. 2, 2014, the contents of all of which are incorporated herein by reference in their entirety.

TECHNICAL FIELD

This invention relates to an elastic member that has a resin coating layer on a surface and is suitable for use as a sealing member for an opening in a toner container provided in a printer or copier toner cartridge.

BACKGROUND ART

A toner container that is provided with a lid which opens and closes for the supply of toner has hitherto been housed in toner cartridges for printers and copiers, with the toner being supplied whenever the lid opens and closes.

For example, JP-A 2011-64930 (Patent Document 1) discloses a toner cartridge (process cartridge) equipped with a bottle-like toner container (toner bottle). As shown in FIGS. 1 to 3, this toner bottle has, disposed in a freely rotatable manner within an outer cylinder 3, a bottle body 2 having a lid 1 that can be opened and closed. The toner bottle, by rotation of the bottle body 2 within the outer cylinder 3, feeds a predetermined amount of toner t at a given timing from within the bottle body 2 to a developing unit.

That is, the bottle body 2, which is rotatably disposed within and substantially concentric to the outer cylinder 3, has provided, in part of a peripheral wall thereof, an opening 4 for discharging toner. The opening 4 is arranged so as to be opened and closed by the lid 1 attached to the bottle body 2. The lid 1 swings in the manner of a flap, opening and closing the opening 4. At the time of such closure, a peripheral edge of the lid 1 comes into contact with a sealing member 5 attached to the outer periphery of the bottle body 2, preventing leakage of the toner.

Toner supply from this toner bottle is carried out as follows.

Referring to FIG. 1, normally, an outer surface at a tip of the lid 1 is in contact with an inner peripheral surface of the outer cylinder 3 and thereby pressed in a closing direction, and a peripheral edge on an inner surface of the lid 1 is in pressing contact with the sealing member 5, placing the opening 4 in the bottle body 2 is a powder-tightly closed state. From this state, the bottle body 2 rotates counterclockwise in the diagram (in the direction of the arrow) along with a developing operation by a copier or the like and, with the lid 1 in a state that blocks the opening 4 in the bottle body 2, the outer surface at the tip of the lid 1 slides over the inner peripheral surface of the outer cylinder 3. As shown in FIG. 2, when the tip of the lid 1 reaches a toner outlet 6 provided in the outer cylinder 3, the restrained state at the tip of the lid 1 due to the inner peripheral surface of the outer cylinder 3 is released and the lid 1 opens, allowing toner t to pass successively from the bottle body 2 through the opening 4 and between the lid 1 and the sealing member 5 and be discharged from the toner outlet 6 in the outer cylinder 3, so that a predetermined amount of the toner t is supplied to the developing unit. The bottle body 2 then rotates further and, as shown in FIG. 3, the tip of the lid 1 passes beyond the toner outlet 6, whereupon the tip of the lid 1 is again pressed in the closing direction by the inner peripheral surface of the outer cylinder 3 and the peripheral edge on the inner surface of the lid 1 comes into pressing contact with the sealing member 5, placing the opening 4 in the bottle body 2 in a powder-tightly closed state.

Such a toner bottle is constructed so as to discharge and supply the toner t while the bottle body 2 holding the toner t rotates, and so the toner t within the bottle body 2 is constantly being uniformly leveled as it flows, enabling the toner t to be reliably discharged and supplied in a fixed amount at a time. However, because the toner t constantly flows with rotation of the bottle body 2, leakage of the toner t between the lid 1 and the opening 4 tends to arise. To prevent such toner leakage, it is necessary to reliably maintain powder tightness between the sealing member 5 and the lid 1. The lid 1 and the sealing member 5 repeatedly come into close contact and separate due to the opening and closing action, with compression, release and rubbing of the sealing member 5 recurring each time. As a result, the performance of the sealing member 5 is very important for reliably preventing toner t leakage over a long period of time.

Up until now, elastic members having a base made of an elastic material such as polyurethane foam and, formed on the surface thereof, a rein coating layer to impart slideability have been used as such sealing members. For example, Patent Document 2 (JP-A 2002-214895) describes a sealing member which has a polyurethane foam base and also has a resin coating layer obtained by mixing a low-friction powder such as a fluoropolymer powder or a silicone resin powder together with a resin coating made of acrylic resin, urethane resin, silicone resin or the like and applying the mixture onto the surface of the base.

However, in the coating composition that forms the coating layer, the balance between film formability and coefficient of friction fluctuates greatly depending on the combination and content ratio of the base resin and the low-friction powder, making it difficult to form a coating layer that is suitable as the surface layer of a sealing member. Hence, it is currently not always possible to obtain a sealing member having a fully satisfactory performance.

PRIOR ART DOCUMENTS

Patent Documents

Patent Document 1: JP-A 2011-64930
Patent Document 2: JP-A 2002-214895

SUMMARY OF THE INVENTION

Problems to be Solved by the Invention

It is therefore an object of the invention to provide an elastic member which has a resin coating layer endowed with both good film formability and low friction properties, and which is suitable for use as a member for sealing the opening in toner containers provided in the toner cartridges of printers, copiers and the like.

Means for Solving the Problems

The inventor has conducted extensive investigations in order to achieve the above object. As a result, he has discovered that, when producing an elastic member which has a base made of an elastic material such as polyurethane foam on the surface of which has been formed a low-friction resin coating layer and which can be used as, for example, a sealing member in a toner container, by adding from 1.5 to 45 parts by weight of a low-friction powder such as a silicone resin powder or a fluoropolymer powder to 100 parts by weight of a base resin and also adjusting the 100% modulus of the applied film that forms the coating layer to from 22 to 30 MPa, a coating layer having both good film formability and low friction properties can be obtained as the resin coating layer, thus making it possible to obtain an elastic member suitable for use as a sealing member for the opening in a toner container.

Accordingly, the invention provides the elastic members of [1] to [7] below.

[1] An elastic member comprising a base made of an elastic material and, formed on at least part of a surface thereof, a resin coating layer, the elastic member being characterized in that the resin coating layer is an applied film which includes 100 parts by weight of a base resin and from 1.5 to 45 parts by weight of a low-friction powder, and which has a 100% modulus of from 22 to 30 MPa.

[2] The elastic member of [1], wherein the low-friction powder is a silicone resin powder or a fluoropolymer powder.

[3] The elastic member of [1] or [2], wherein the elastic material that forms the base is polyurethane foam.

[4] The elastic member of [3], wherein the polyurethane foam has been expansion molded by mechanical frothing.

[5] The elastic member of any of [1] to [4] which includes an aqueous urethane resin as the base resin of the resin coating layer.

[6] The elastic member of any of [1] to [5] which includes a polycarbonate resin or an acrylic resin as part of the base resin of the resin coating layer.

[7] The elastic member of any of [1] to [6] which is a sealing member adapted for use between an opening in a toner container provided in a toner cartridge and a lid which opens and closes the opening.

Advantageous Effects of the Invention

The elastic member of the invention has, formed on the surface thereof, a coating layer in which the content of low-friction powder and the 100% modulus have been optimized and which is endowed with both good film formability and low friction properties. By using this elastic member as, for example, a sealing member in a toner container, good sealing properties can be reliably exhibited over an extended period of time and the reliability of the printing performance with a printer or copier can be increased.

BRIEF DESCRIPTION OF THE DIAGRAMS

EMBODIMENT FOR CARRYING OUT THE INVENTION

Figure 1:
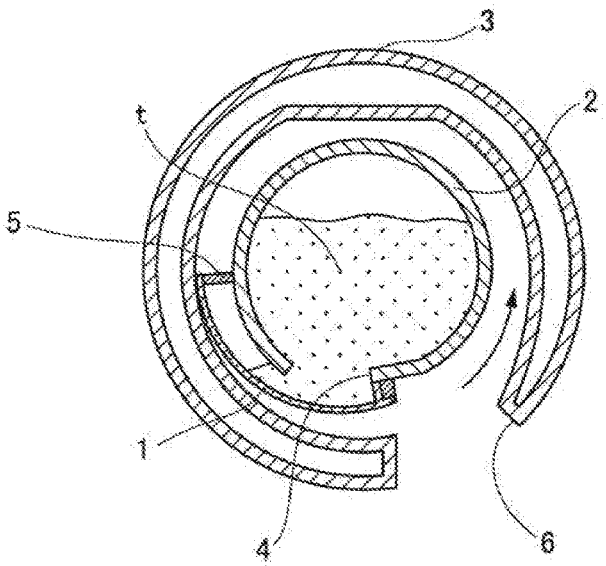
FIG. 1 PRIOR ART
FIG. 1 is a schematic cross-sectional diagram showing an example of a prior art sealing member which, at an opening in a toner container, seals between the lid and the toner container.
Figure 2:
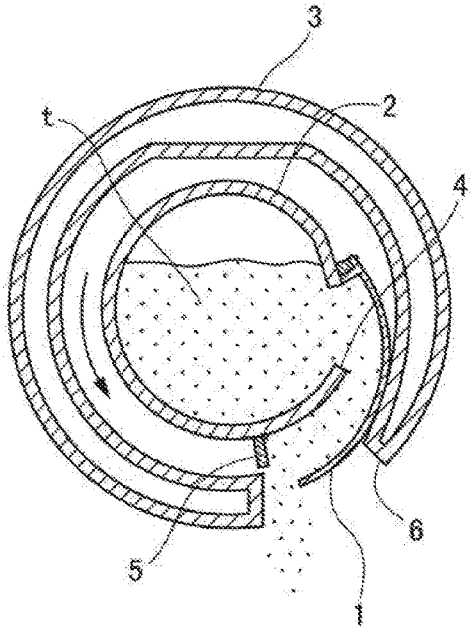
FIG. 2 PRIOR ART
FIG. 2 is a schematic cross-sectional diagram showing the same sealing member in a state where the opening in the toner container is open and toner is being discharged.
Figure 3:
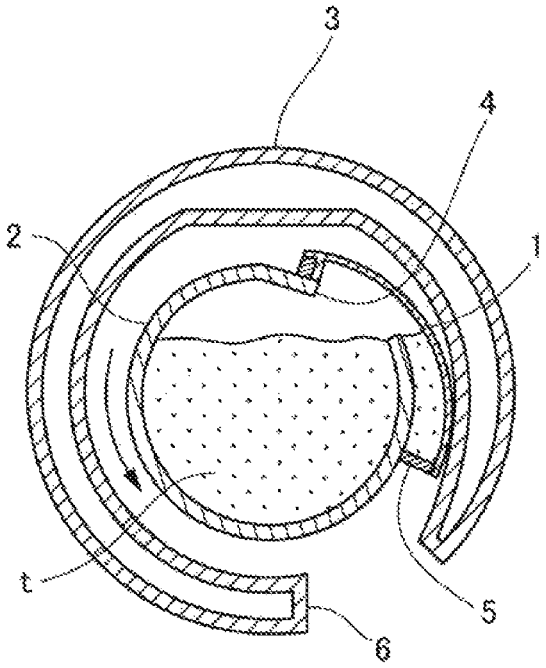
FIG. 3 PRIOR ART
FIG. 3 is a schematic cross-sectional diagram showing the same sealing member in a state where, following toner discharge, the opening in the toner container has again been closed by the lid.
Figure 4:
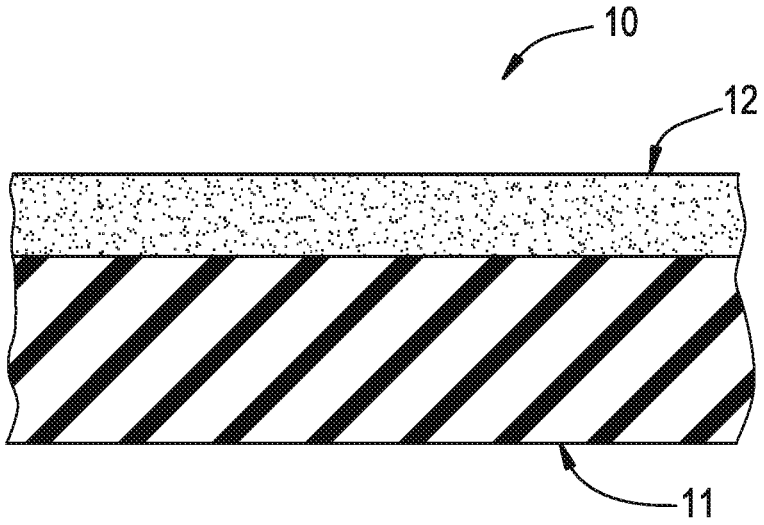
FIG. 4 is a schematic cross-sectional diagram showing an elastic member in accordance with the invention.

As mentioned above, the elastic member of the invention has, formed on at least part of the surface of a base made of an elastic material, a resin coating layer which includes a low-friction powder. For example, referring to FIG. 4, elastic member 10 includes base 11 made of elastic material, and resin coating layer 12 which includes a low-friction powder.

The elastic material that forms the base may be suitably selected without particular limitation from various expanded resins and various elastomers and rubbers depending on, for example, the intended use of the elastic member of the invention. When the elastic member is to be used as the above-described sealing member for an opening in a toner container, the use of an expanded resin such as polyurethane, polyethylene, polypropylene or ethylene vinyl acetate is preferred, with polyurethane foam being especially preferred.

The polyurethane foam serving as the elastic material that forms the base can be obtained by expanding a polyurethane foam composition in which the primary ingredients are a polyol and an isocyanate compound.

Here, the polyol is preferably one having a number-average molecular weight of from 600 to 10,000, and more preferably one having a number-average molecular weight of from 2,000 to 5,000. It is recommended that the hydroxyl (OH) number of the polyol be from 20 to 280, and especially from 20 to 60. Such polyols that can be used include polyether polyols, polyester polyols, polyester polyether polyols, polycarbonate polyols and, as modified polyols thereof, styrene and/or acrylonitrile-grafted polymer polyols. The use of a polyether polyol is especially preferred. These may be used singly or two or more may be used in combination.

Commercial products may be used as the polyols. Illustrative examples include GS-3000 (a polyether polyol; molecular weight, 3,000; f=3) available from Sanyo Chemical Industries, Ltd., V3943A (an acrylonitrile/styrene 43% grafted copolymer polyol; molecular weight of base polymer, 3,000; f=3) available from Dow Polyurethane Japan, Ltd., and 3P56D (a polyester polyether polyol; molecular weight, 3,000; f=3) available from Mitsui Chemical Polyurethane KK.

The isocyanate compound is exemplified by aromatic, alicyclic and aliphatic polyisocyanates having two or more isocyanate groups, mixtures thereof, and modified polyisocyanates obtained by modifying these. Illustrative examples include aromatic polyisocyanates such as tolylene diisocyanate, methylene diphenyl diisocyanate, naphthylene diisocyanate, xylylene diisocyanate and polymethylene polyphenylene isocyanate; alicyclic polyisocyanates such as hydrogenated methylene diphenyl diisocyanate, hydrogenated tolylene diisocyanate and isophorone diisocyanate; aliphatic polyisocyanates such as hexamethylene diisocyanate and lysine diisocyanate; as well as mixtures thereof, and modified polyisocyanates thereof. Examples of modified polyisocyanates include prepolymer-type modified polyisocyanates which are reaction products of a polyisocyanate and a polyol, nurate-modified polyisocyanates, urea-modified polyisocyanates, carbodiimide-modified polyisocyanates, allophanate-modified polyisocyanates and biuret-modified polyisocyanates.

The amount of isocyanate included is not particularly limited, although it is preferable to set the isocyanate index to from 70 to 150, and more preferably from 90 to 120. By setting the isocyanate index to 70 or more, the resinification reaction proceeds better, enabling a good durability to be obtained. By setting the isocyanate index to not more than 150, the good cushioning properties and gas permeability of urethane foam can be obtained. "Isocyanate index" refers to the equivalent weight ratio (in percent) of isocyanate groups with respect to active hydrogen groups (e.g., hydroxyl groups on polyol and water as the blowing agent) in compounding.

As with conventional polyurethane foam compositions, this polyurethane foam composition may optionally include known additives such as blowing agents, catalysts and foam stabilizers.

Here, a blowing agent may be included as appropriate for, e.g., expansion molding. For example, water may be suitably used as the blowing agent, although use can also be made of low-boiling compounds such as methylene chloride or monofluorotrichloromethane. The amount of blowing agent included is suitably adjusted without particular limitation, but can generally be set to from 0 to 15 parts by weight, especially from 0 to 5 parts by weight, per 100 parts by weight of the total polyol.

Amine catalysts and metal catalysts may be suitably used as the catalyst. Illustrative examples of amine catalysts include tetramethylhexamethylenediamine, pentamethyldiethylenetriamine, dimethylcyclohexylamine, bis(dimethylaminoethyl) ether, tetramethylpropylenediamine, trimethylaminoethylpiperazine, tetramethylethylenediamine, dimethylbenzylamine, methylmorpholine, ethylmorpholine and triethylenediamine. Illustrative examples of metal catalysts include stannous octate, dibutyltin dilaurate, nickel octanoate, calcium octanoate, stannous oleate, cobalt naphthenate and lead naphthenate. These catalysts may be used singly or two or more may be used together. The amount of catalyst included per 100 parts by weight of the total polyol may be set to, for example, 0 to 5 parts by weight, especially 0.01 to 2 parts by weight.

Illustrative examples of foam stabilizers include organopolysiloxanes, alkyl carboxylates and alkyl benzene sulfonates. The amount of foam stabilizer included per 100 parts by weight of the total polyol may be set to 0 to 5 parts by weight, especially 0.3 to 4 parts by weight.

Various additives other than the above may also be optionally included in the polyurethane foam composition that forms the base of the inventive elastic member. For example, colorants such as pigments and dyes, fillers such as calcium carbonate, moisture absorbents such as zeolite, crosslinking agents, antioxidants, flame retardants, UV absorbers, light stabilizers, electrically conductive substances such as carbon black, antimicrobial agents, wetting and dispersing agents, thickeners and viscosity depressants may be included.

The base of the inventive elastic member can be obtained by expanding this polyurethane foam composition. The method of expansion employed is not particularly limited and may be, for example, a known method such as a one-shot method, a prepolymer method or mechanical frothing. Particularly in cases where the elastic member of the invention is to be used as a sealing member in a toner container, from the standpoint of toner sealability, durability and the like, it is preferable to use mechanical frothing, which is capable of obtaining a foam that homogeneously provides a fine cell diameter.

Mechanical frothing is a method which, during stirring and thorough mixture of the polyurethane composition without the addition thereto of a specific blowing agent, forms bubbles by mixing in a foaming gas such as air or an inert gas and directly heating and curing in this state to form a polyurethane foam.

For example, a polyurethane foam in the desired shape can be obtained by mixing and stirring beforehand the polyol ingredients, catalyst, additives and the like so as to prepare a polyol solution, using a mechanical frothing machine to mix together, stir and mechanically incorporate bubbles into the polyol solution and a polyisocyanate compound, and then continuously expanding the resulting mixture as a sheet or casting it into a mold. The polyurethane foam thus obtained has thermoformability, and can be additionally thermoformed by hot pressing.

The density of the polyurethane foam is suitably set according to, for example, the intended use of the inventive elastic member and is not particularly limited, although it is preferably set to from about 150 to about 600 kg/m$^3$, and more preferably from about 200 to about 450 kg/m$^3$. The foam density can be adjusted by regulating the amount of air incorporated, the stirring time, the stirring strength and the amount of catalyst.

As noted above, the elastic member of the invention has, on at least part of a surface of the base made of an elastic material such as the above polyurethane foam, a resin coating layer that contains a low-friction powder.

The base resin that forms this resin coating layer is not particularly limited. However, especially in cases where the elastic member of the invention is to be used as the above-described sealing member in a toner container, preferred use can be made of a resin having both flexibility capable of conforming to the elasticity of the base and a low coefficient of dynamic friction. Specifically, use can be made of one type of resin such as a polyurethane resin, acrylic resin, silicone resin, polycarbonate resin or fluoropolymer, or a mixture or copolymer of two or more thereof. Of these, in terms of the compatibility with the above-described polyurethane foam that is preferably used as the base, the use of a polyurethane resin is preferred, with an aqueous polyurethane resin being especially preferred. A suitable amount of polycarbonate resin, acrylic resin or the like may be mixed into and used with the polyurethane resin in order to adjust the resin properties.

Commercial products may be used as these base resins. Illustrative examples include Bayhydrol UH2606 and Bayhydrol UHXP2648 from Bayer Material Science, and Resamine from Dainichiseika Color & Chemicals Mfg. Co., Ltd.

In the practice of the invention, the 100% modulus of this resin coating layer is adjusted to from 22 to 30 MPa, and preferably from 24 to 28 MPa. Adjustment of this 100% modulus may be carried out by selection of the above base resin. In such a case, subtle adjustment can be carried out by mixing together a plurality of resin types. Moreover, even when a polyurethane resin, for example, is used, the 100% modulus can be adjusted by using a plurality of polyurethane resins having differing hardnesses and regulating the mixing ratio thereof. The 100% modulus should be measured in accordance with JIS K7311.

When the 100% modulus of the resin coating layer is less than 22 MPa, the film formability is good, but the coefficient of dynamic friction becomes larger. On the other hand, when the 100% modulus exceeds 30 MPa, the coefficient of dynamic friction is smaller, but the film formability of the coating decreases and it becomes difficult to form a good applied film that is free of defects. The object of the invention cannot be achieved in either of these cases.

A low-friction powder is included in the resin coating layer. The low-friction powder is not particularly limited, although preferred use can be made of fluoropolymers such as polytetrafluoroethylene (PTFE), tetrafluoroethylene-perfluoroalkylvinyl ether copolymer (PFA) and tetrafluoroethylene-hexafluoropropylene copolymer (FEP), and silicone resin powders. In addition to fluoropolymers and silicone resins, it is also possible to use, for example, surface-treated silica particles and surface-treated acrylic resins. The combined use of a plurality of resin types—fluoropolymer, silicone resin and other resins—is also possible.

There are no limitations on the shape and size of the particles of low-friction powder, although it is preferable for the particle shape to be spherical. Also, for the particles to be suitably exposed at the surface of the resin coating layer so as to effectively lower the coefficient of dynamic friction, although not particularly limited, it is preferable for the mean particle size D50 to be from 1 to 20 μm, and more preferably from 2 to 10 μm.

In this invention, the amount of the low-friction powder included per 100 parts by weight of the base resin is set to from 1.5 to 45 parts by weight, preferably from 1.5 to 20 parts by weight, more preferably from 2 to 20 parts by weight, even more preferably from 5 to 20 parts by weight, and still more preferably from 10 to 20 parts by weight. When the amount of low-friction powder included is less than 1.5 parts by weight, the film formability of the coating is good, but the coefficient of dynamic friction becomes large. On the other hand, when the amount of low-friction powder exceeds 45 parts by weight, the coefficient of dynamic friction is small and the film formability of the coating decreases, making it difficult to form a good applied film that is free of defects. The object of the invention cannot be achieved in either of these cases.

Aside from the base resin and the low-friction powder mentioned above, known additives, including colorants such as pigments and dyes, fillers such as calcium carbonate, crosslinking agents, antioxidants, flame retardants, UV absorbers, light stabilizers, electrically conductive substances such as carbon black, antimicrobial agents, wetting and dispersing agents, thickeners, viscosity depressants, surface modifiers, and wax additives may be optionally added to the resin coating layer. The resin coating layer can be obtained by dissolving the base resin, the low-friction powder and necessary additives in water or another solvent to prepare a coating, and then applying this coating onto the surface of the elastic base to form a film. A co-solvent such as butyl cellosolve or methyl cellosolve may be used at this time. The method of applying the coating may be suitably selected from among known methods such as spraying, roll coating and dipping.

The low-friction powder is typically incorporated by addition and dispersion within the base resin-containing coating. However, in some cases, a coating that includes the base resin may be applied and the low-friction powder then immediately sprayed onto the surface of the applied film and fixed thereto. The thickness of the resin coating layer is suitably set according to, for example, the intended use, size and thickness of the elastic member, and is not particularly limited. For instance, the thickness may be set to from 0.5 to 20 μm, and more preferably from 2 to 5 μm.

EXAMPLES

The invention is illustrated more fully below by way of Working Examples and Comparative Examples, although the invention is not limited by these Examples.

Working Examples 1 to 4, Comparative Examples 1 to 5

The polyurethane composition formulated as shown below was stirred in an Cakes mixer while feeding 113 cc/min of air per 100 cc/min of polyol. The reaction mixture was then sheeted onto a film with a bar coater and dried at 150° C. for 15 minutes, giving a 2 mm×500 mm×500 mm polyurethane foam sheet. This was used as the base.

[Polyurethane Composition]

| | |
|---|---|
| Polyol 1 (Sannix GS-3000, from Sanyo Chemical Industries, Ltd.) | 100 parts by weight |
| Polyol 2 (1,4-butanediol, from BASF) | 5 parts by weight |
| Isocyanate (isocyanate index, 105) (Sumidur 44V20, from Sumika Bayer Urethane KK) | 30 parts by weight |
| Tin catalyst | 0.02 part by weight |
| Silicone foam stabilizer (NIAX SILICONE L626, from Momentive Performance Materials Japan) | 4 parts by weight |

In a separate procedure, water-based coatings formulated as shown in Table 1 were prepared. Each of the resulting water-based coatings was applied by spraying onto one surface of the sheet-like base made of polyurethane foam and dried to form a resin coating layer having a thickness of 2 to 3 μm, thereby giving an elastic member having a resin coating layer on the surface. The appearance of the resin coating layer at this time was visually checked and the film formability was evaluated based on the presence/absence of defects. The coefficient of dynamic friction on the resin coating layer-forming surface of each of the elastic members obtained was measured in accordance with JIS K7125. In addition, a 100 μm thick film was formed from each water-based coating by solvent casting, and the 100% modulus was measured in accordance with JIS K7311. These results are shown in Table 1.

Details on Water-based coatings A to D and the low-friction powder in Table 1 are given below.

Water-based coating A: Bayhydrol UH2606 [polycarbonate-containing aliphatic polyurethane dispersion coating (resin content, 35%)]

Water-based coating B: Bayhydrol MAXP2648 [polycarbonate-containing aliphatic polyurethane dispersion coating (resin content, 35%)]

Water-based coating C: Bayhydrol UH2342 [fatty acid-modified polyurethane dispersion coating (resin content, 35%)]

Water-based coating D: Bayhydrol UHXP2592 [oxidation-dried polyester-polyurethane dispersion coating (resin content, 45%)]

Low-friction powder: Tospearl 145 [silicone resin fine particles (spherical; average particle size, 4.5 μm)]

TABLE 1

| | | Comp. Ex. | Working Example | | Comparative Example | | | | Working Example | |
|---|---|---|---|---|---|---|---|---|---|---|
| | | 1 | 1 | 2 | 2 | 3 | 4 | 5 | 3 | 4 |
| Formulation (pbw) | Water-based coating A (resin content, 35 wt %) | 100 | 80 | 60 | 50 | 40 | 20 | 0 | 0 | 0 |
| | Water-based coating B (resin content, 35 wt %) | 0 | 20 | 40 | 50 | 60 | 80 | 100 | 0 | 0 |
| | Water-based coating C (resin content, 35 wt %) | 0 | 0 | 0 | 0 | 0 | 0 | 0 | 100 | 0 |
| | Water-based coating D (resin content, 45 wt %) | 0 | 0 | 0 | 0 | 0 | 0 | 0 | 0 | 100 |
| | Low-friction powder* | 6 (17.14) | 6 (17.14) | 6 (17.14) | 6 (17.14) | 6 (17.14) | 6 (17.14) | 6 (17.14) | 6 (17.14) | 6 (13.33) |
| | Co-solvent (butyl cellosolve) | 6 | 6 | 6 | 6 | 6 | 6 | 6 | 6 | 6 |
| | Diluent (water) | 88 | 88 | 88 | 88 | 88 | 88 | 88 | 88 | 88 |
| Film properties | 100% modulus (MPa) | 32 | 27.6 | 23.2 | 21 | 18.8 | 14.4 | 10 | 22 | 22.5 |
| Product properties | Film formability | NG | good | good | good | good | good | good | good | good |
| | Dynamic friction coefficient | — | 0.37 | 0.4 | 0.5 | 0.63 | 0.71 | 0.65 | 0.38 | 0.4 |

*Numbers in parenthesis are parts by weight per 100 parts by weight of the resin ingredients in the coating.

Working Examples 5 to 7, Comparative Examples 6 to 8

Water-based coatings in which the content of the low-friction powder (Tospearl 145) was changed as shown in Table 2 from the formulation in Working Example 1 were prepared, and elastic members having a resin coating layer on the surface were produced in the same way as in Working Example 1. The 100% modulus, film formability and coefficient of dynamic friction for the resulting resin coating layers and elastic members were measured or evaluated in the same way as in Working Example 1. The results are shown in Table 2, which also presents the results for Working Example 1.

TABLE 2

| | | Comp. Ex. | Working Example | | | | Comparative Example | |
|---|---|---|---|---|---|---|---|---|
| | | 6 | 5 | 6 | 1 | 7 | 7 | 8 |
| Formulation (pbw) | Water-based coating A (resin content, 35 wt %) | 80 | 80 | 80 | 80 | 80 | 80 | 80 |
| | Water-based coating B (resin content, 35 wt %) | 20 | 20 | 20 | 20 | 20 | 20 | 20 |
| | Low friction powder* | 0 | 0.6 (1.71) | 2 (5.71) | 6 (17.14) | 15.7 (44.86) | 17.5 (50) | 35 (100) |
| | Co-solvent (butyl cellosolve) | 6 | 6 | 6 | 6 | 6 | 6 | 6 |
| | Diluent (water) | 88 | 88 | 88 | 88 | 88 | 88 | 88 |
| Film properties | 100% modulus (MPa) | 27.6 | 27.6 | 27.6 | 27.6 | 27.6 | 27.6 | 10 |
| Product properties | Film formability | good | good | good | good | good | NG | NG |
| | Dynamic friction coefficient | 0.42 | 0.4 | 0.39 | 0.37 | 0.37 | 0.35 | 0.37 |

*Numbers in parenthesis are parts by weight per 100 parts by weight of the resin ingredients in the coating.

As shown in Tables 1 and 2, the elastic members of Working Examples 1 to 7 in which the low-friction powder content and the 100% modulus of the resin coating layer were optimized had an excellent resin coating layer film formability and, with a coefficient of dynamic friction of 0.4 or less, also had good low-friction properties.

By contrast, the elastic members of Comparative Examples 2 to 5, wherein the 100% modulus of the applied film that forms the resin coating layer was less than 22 MPa, had a large coefficient of dynamic friction that exceeds 0.4, and thus had poor low-friction properties. In Comparative Example 1, wherein the 100% modulus exceeded 30 MPa, the film formability was poor and cracking and peeling arose, making it impossible to form a good resin coating layer. Also, in Comparative Example 6 which contained no low-friction powder, although the 100% modulus was optimized, the coefficient of dynamic friction was large, exceeding 0.4. Conversely, in Comparative Examples 7 and 8, wherein the content of low-friction powder exceeded 45 parts by weight per 100 parts by weight of the resin components, the coefficient of dynamic friction was good but the film formability was poor.

REFERENCE SIGNS LIST

1 Lid
2 Bottle body (toner container)
3 Outer cylinder
4 Opening
5 Sealing member (elastic member)
6 Toner outlet
t Toner

The invention claimed is:

1. An elastic member comprising a base made of an elastic material and, formed on at least part of a surface thereof, a resin coating layer, the elastic member being characterized in that the resin coating layer is an applied film which includes 100 parts by weight of a base resin and from 1.5 to 45 parts by weight of a low-friction powder, and which has a 100% modulus of from 22 to 30 MPa.

2. The elastic member of claim 1, wherein the low-friction powder is a silicone resin powder or a fluoropolymer powder.

3. The elastic member of claim 1, wherein the elastic material that forms the base is polyurethane foam.

4. The elastic member of claim 3, wherein the polyurethane foam has been expansion molded by mechanical frothing.

5. The elastic member of claim 1 which includes an aqueous urethane resin as the base resin of the resin coating layer.

6. The elastic member of claim 1 which includes a polycarbonate resin or an acrylic resin as part of the base resin of the resin coating layer.

7. The elastic member of claim 1 which is a sealing member adapted for use between an opening in a toner container provided in a toner cartridge and a lid which opens and closes the opening.

* * * * *